US008202102B2

(12) United States Patent
Kim et al.

(10) Patent No.: US 8,202,102 B2
(45) Date of Patent: Jun. 19, 2012

(54) EARTH TERMINAL

(75) Inventors: Jong Soo Kim, Gyeonggi-do (KR); Cheol Hun Lee, Gyeonggi-do (KR); Hak-Cheol Lee, Incheon (KR); Jong-Myung Oh, Gyeonggi-do (KR)

(73) Assignees: Hyundai Motor Company, Seoul (KR); Kia Motors Corporation, Seoul (KR); Kyungshin Industrial Company, Incheon (KR); Yura Corporation Co., Ltd., Chungbuk (KR)

( * ) Notice: Subject to any disclaimer, the term of this patent is extended or adjusted under 35 U.S.C. 154(b) by 0 days.

(21) Appl. No.: 12/887,023

(22) Filed: Sep. 21, 2010

(65) Prior Publication Data

US 2011/0104961 A1 May 5, 2011

(30) Foreign Application Priority Data

Nov. 2, 2009 (KR) ..... 10-2009-0104888

(51) Int. Cl.
*H01R 13/648* (2006.01)

(52) U.S. Cl. ..... 439/92

(58) Field of Classification Search ..... 439/92, 439/95, 96, 801, 287, 177, 382; 174/51
See application file for complete search history.

(56) References Cited

U.S. PATENT DOCUMENTS

| | | | | |
|---|---|---|---|---|
| 5,579,055 | A * | 11/1996 | Hamilton et al. | 725/49 |
| 6,206,718 | B1 * | 3/2001 | Takahashi et al. | 439/382 |
| 6,623,885 | B1 * | 9/2003 | Watanabe et al. | 429/178 |
| 6,783,377 | B2 * | 8/2004 | Aoyama | 439/92 |
| 2009/0181563 | A1 * | 7/2009 | Lin et al. | 439/92 |

FOREIGN PATENT DOCUMENTS

| | | | |
|---|---|---|---|
| JP | 09092360 | A | 4/1997 |
| JP | 2000182688 | A | 6/2000 |
| KR | 10-1998-0006640 | | 3/1998 |
| KR | 20-2004-0021434 | | 10/2004 |
| KR | 10-2005-0042334 | | 5/2005 |

* cited by examiner

*Primary Examiner* — Alexander Gilman
(74) *Attorney, Agent, or Firm* — Edwards Wildman Palmer LLP; Peter F. Corless

(57) ABSTRACT

An earth terminal is disclosed. The earth terminal includes a fixing member fixed to a vehicle body by a bolt, a barrel member to which an earth wire is inserted and fixed, and a cut member for connecting the fixing member and the barrel member, in which the cut member is broken or disengaged by bending. Since the cut member is bent and broken, if necessary, the earth wire is easily and conveniently disengaged from the vehicle body to enhance a disengaging performance of a wire harness.

6 Claims, 4 Drawing Sheets

EARTH TERMINAL

CROSS-REFERENCE TO RELATED APPLICATION

This application claims under 35 U.S.C. §119(a) the benefit of Korean Patent Application No. 10-2009-0104888, filed on Nov. 2, 2009 in the Korean Intellectual Property Office, the disclosure of which is incorporated herein in its entirety by reference.

BACKGROUND OF THE INVENTION

1. Field of the Invention

The present invention relates, generally, to an earth terminal, and more particularly, to an earth terminal that is capable of easily disengaging an earth wire.

2. Background Art

In general, an earth terminal is adapted to connect an electric wire with the vehicle body of an automobile, and the earth terminal is fixed to the vehicle body by means of a ground bolt.

FIG. 1 is an exemplary perspective view illustrating an earth terminal according to the prior art.

Referring to FIG. 1, the earth terminal 10 of the prior art preferably includes a plate 11 provided with a fastening hole 12 to which a ground bolt (not shown) is fastened, and a wire barrel 13 formed on one side of the plate 11 and enclosing one end portion of an earth wire (not shown).

With the earth terminal of the prior art, after the earth wire is placed on the wire barrel 13, the wire barrel 13 is suitably crimped to fix the earth wire, and the ground bolt is suitably fastened to the vehicle body through the fastening hole 12 of the plate 11.

Preferably, the electric wire can be easily connected to the vehicle body by using the earth terminal 10.

The above-described earth terminal 10 cannot be disengaged from the vehicle body unless the ground bolt is removed. In particular, domestic and foreign vehicle recycling regulations (ELV Regulations) prescribe that the earth wires should be disengaged from the vehicle body and be then collected. Accordingly, the collection of the earth wires is hardly collected.

In addition, according to the earth terminal of the prior art, since the earth wire is fixed by pressing force of the wire barrel, in examples where the earth wire is pulled by the external force, only the earth wire is disengaged from the earth terminal.

Accordingly, there remains a need in the art for an earth terminal that is capable of easily and conveniently collecting an earth wire.

The above information disclosed in this the Background section is only for enhancement of understanding of the background of the invention and therefore it may contain information that does not form the prior art that is already known in this country to a person of ordinary skill in the art.

SUMMARY OF THE INVENTION

In preferred aspects, the present invention provides an earth terminal that is capable of easily and conveniently collecting an earth wire.

In preferred embodiments, the present invention features an earth terminal which preferably includes a fixing member suitably fixed to a vehicle body by a bolt; a barrel member to which an earth wire is suitably inserted and fixed; and a cut member for suitably connecting the fixing member and the barrel member, in which the cut member is broken or disengaged by bending.

According to certain preferred embodiments, the cut member has a joint portion suitably formed at one portion of a surface corresponding to the fixing member and the barrel member, and a connecting portion suitably formed at the other portion of the surface corresponding to the fixing member and the barrel member.

Preferably, the joint portion is provided at its center portion thereof with a weak portion which is bent in ∩-shaped cross-section.

According to certain preferred embodiments, the connecting portion has a support piece suitably formed on the fixing member in a cantilever form, and a connecting piece suitably formed on the barrel member and formed in a hook shape to be connected to the support piece.

Preferably, the support piece is composed of an engaging surface engaged to the engaging piece in an overlapped manner, and a locking surface supported by a distal end of the engaging piece.

The earth terminal according to another preferred embodiment of the present invention further includes a rotation preventive portion formed on one side of the fixing member and preferably bent in a direction perpendicular to the fixing member.

Preferably, with the configuration of the earth terminal, since the cut member is suitably bent and broken, if necessary, the earth wire is easily and conveniently disengaged from the vehicle body to enhance a disengaging performance of a wire harness.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum).

As referred to herein, a hybrid vehicle is a vehicle that has two or more sources of power, for example both gasoline-powered and electric-powered.

The above features and advantages of the present invention will be apparent from or are set forth in more detail in the accompanying drawings, which are incorporated in and form a part of this specification, and the following Detailed Description, which together serve to explain by way of example the principles of the present invention.

BRIEF DESCRIPTION OF THE DRAWINGS

The above and other objects, features and advantages of the present invention will be more apparent from the following detailed description taken in conjunction with the accompanying drawings, in which.

Figure 1:
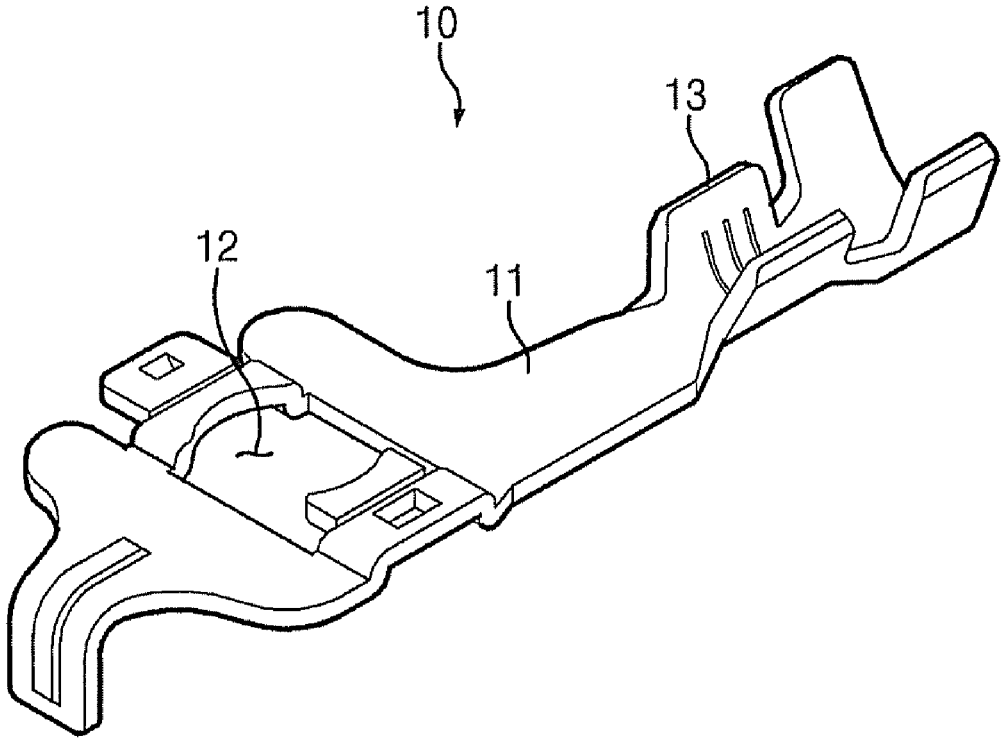
Fig.1 (Prior Art)
FIG. 1 is a perspective view illustrating an exemplary earth terminal of he prior art.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

DETAILED DESCRIPTION OF THE PREFERRED EMBODIMENTS

In preferred aspects, the present invention features an earth terminal comprising a fixing member fixed to a vehicle body by a bolt, a barrel member to which an earth wire is inserted and fixed, and a cut member for connecting the fixing member and the barrel member.

In one embodiment, the cut member is broken or disengaged by bending.

Hereinafter, preferred embodiments of the present invention will be described in detail with reference to the accompanying drawings. The aspects and features of the present invention and methods for achieving the aspects and features will be apparent by referring to the embodiments to be described in detail with reference to the accompanying drawings. However, the present invention is not limited to the embodiments disclosed hereinafter, but can be implemented in diverse forms. The matters defined in the description, such as the detailed construction and elements, are nothing but specific details provided to assist those of ordinary skill in the art in a comprehensive understanding of the invention, and the present invention is only defined within the scope of the appended claims. In the entire description of the present invention, the same drawing reference numerals are used for the same elements across various figures.

The configuration of an earth terminal according to preferred embodiments of the present invention are now described in detail with reference to FIGS. 2 to 4.

Figure 2:
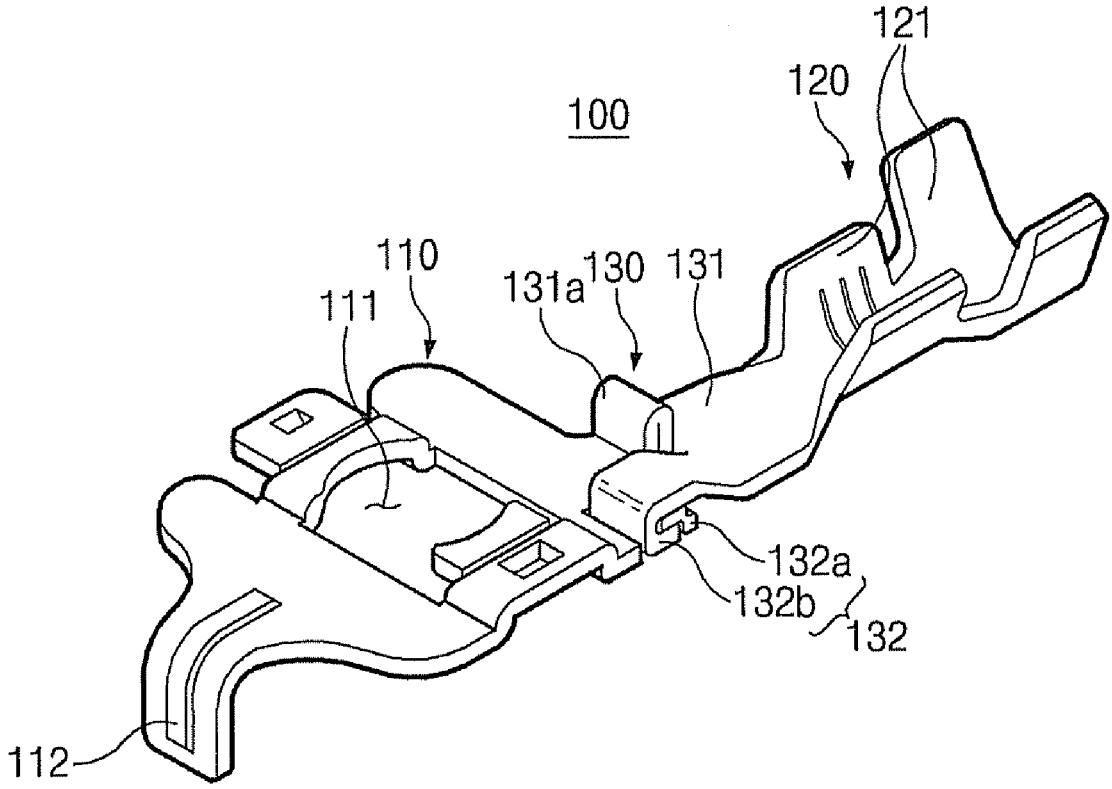
FIG. 2 is a perspective view illustrating an earth terminal according to a preferred embodiment of the present invention.

Preferably, the earth terminal 100 according to preferred embodiments of the present invention includes, for example as shown in FIG. 2, a fixing member 110 suitably fixed to a vehicle body by means of a bolt (not shown), a barrel member 120 suitably receiving and fixing an earth wire (not shown), and a cut member 130 suitably connecting the fixing member 110 and the barrel member 120, in which the cut member being bent and cut, if necessary, in order to conveniently disengage an earth wire from the vehicle body.

In particular preferred embodiments, when the earth wire is suitably disengaged from the vehicle body through the earth terminal 100 of the present invention, a weak portion of the cut portion 130 is broken by pulling the earth wire or vending the barrel member 120, to which the earth wire is suitably fixed, from the fixing member 110 in a vertical direction. Accordingly, as a result, the fixing member 110 is suitably detached from the barrel member 120, so that the earth wire can be suitably disengaged from the vehicle body.

The earth terminal 100 having the configuration as described above is described in detail with reference to the accompanying drawings.

According to certain preferred embodiments of the present invention, the fixing member 110 is suitably adapted to be connected to the vehicle body, for example as shown in FIG. 2, and is suitably provided at a portion thereof with a fastening hole 111 for fastening a bolt. Preferably, the fixing member 110 has a rotation preventive portion 112, vertically vent in a downward direction, for suitably positioning the fixing member 110 and suitably preventing rotation of the fixing member 110.

According to other preferred embodiment of the present invention, the barrel member 120 is suitably adapted to fix the earth wire, and has on an upper portion thereof a wire barrel 121 for suitably pressing the earth wire in an enclosing manner to fix the earth wire.

Figure 3:
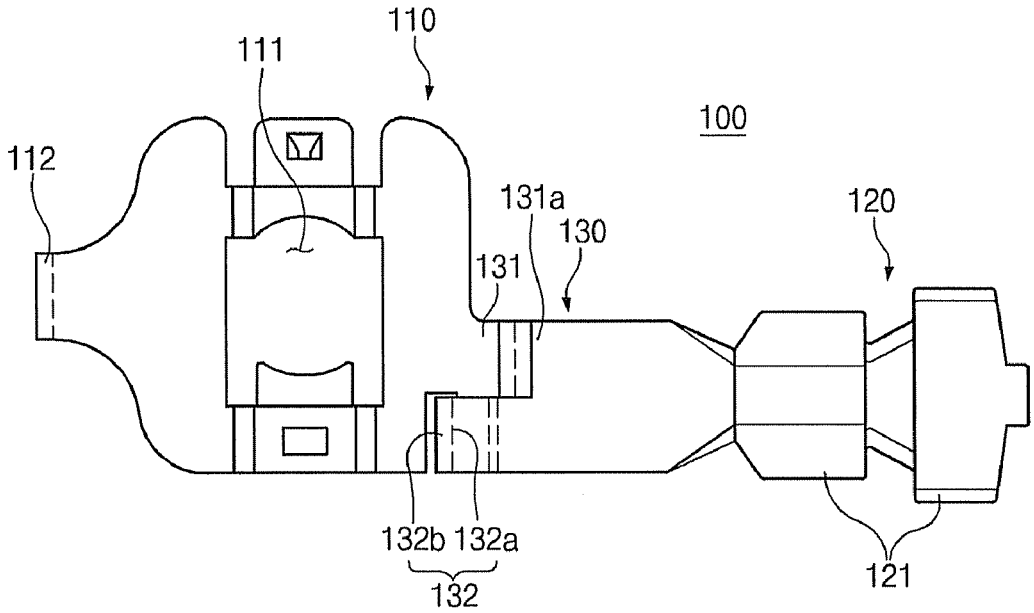
FIG. 3 is a plan view of an earth terminal according to a preferred embodiment of the present invention.
Figure 4:
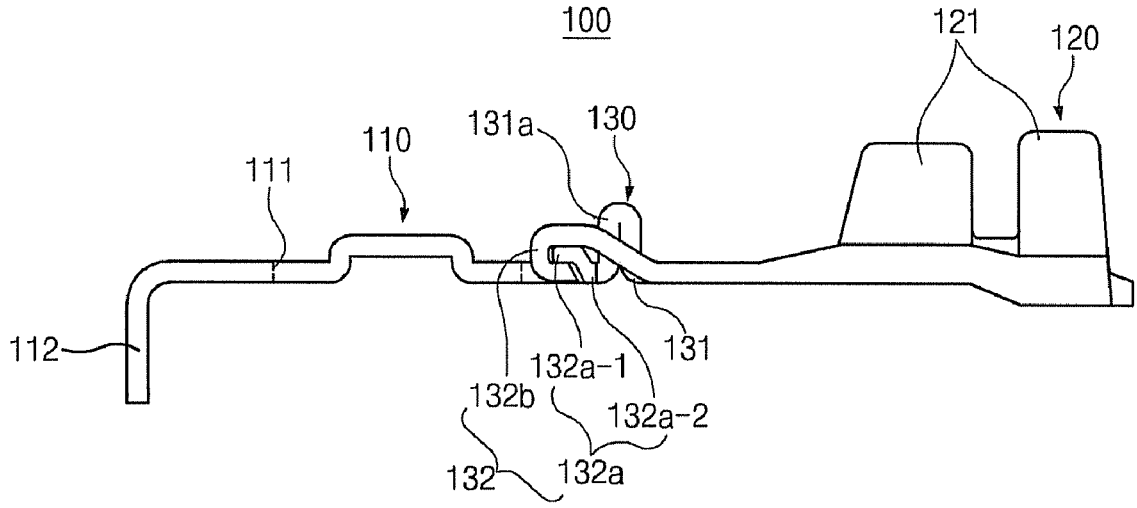
FIG. 4 is a side view of an earth terminal according to a preferred embodiment of the present invention.

Preferably, the cut member 130 is suitably adapted to connect the fixing member 110 and the barrel member 120, as shown in FIGS. 3 and 4, and, simultaneously, to be bent to cut the cut member, if necessary. Further, in certain preferred embodiments, the cut member 130 has a joint portion 131 suitably formed at one portion of a surface corresponding to the fixing member 110 and the barrel member 120, and a connecting portion 132 suitably formed at the other portion of the surface corresponding to the fixing member 110 and the barrel member 120.

Preferably, the joint portion 131 connects integrally one corresponding side of the fixing member 110 and the barrel member 120. In particular preferred embodiments, the joint portion 131 connects the fixing member 110 and the barrel member 120 in a longitudinal direction.

Preferably, the joint portion 131 is provided at its center portion thereof with a weak portion 131*a* for bending and cutting the joint portion. In particular, the weak portion 131*a* is suitably formed by bending the center portion of the joint portion 131 of the weak portion 131*a* in a ∩-shaped cross-section.

Preferably, that is, according to preferred embodiments of the present invention, since the portion which is bent in the ∩-shaped cross-section is suitably applied with a tensile force and a compression force at an outer portion and an inner portion, the weak portion 131*a* is suitably applied with stress. Accordingly, in this instance, if the weak portion 131*a* is repeatedly bent in a vertical direction, the bent portion is suitably broken by the stress applied to the bent portion.

According to further preferred embodiments, the connecting portion 132 is suitably adapted to connect the other corresponding sides of the fixing member 110 and the barrel member 120 to reinforce the connecting strength of the fixing member 110 and the barrel member 120.

In particular preferred embodiments, the connecting portion 132 has a support piece 132*a* that is suitably formed on the other side of the fixing member 110 and extending from the side of the joint portion 131 in a cantilever form, and a connecting piece 132*b* suitably formed on the other side of the barrel member 120 corresponding to the support piece 132*a* and having a hook shape to be suitably connected to the support piece 132*a*.

Preferably, the support piece 132*a* is constituted of an engaging surface 132*a*-1 and a locking surface 132*a*-2 which are bent in a stepped form, in which the engaging surface 132*a*-1 is suitably engaged to the engaging piece 132*b* in an overlapped manner, and the locking surface 132*a*-2 is supported by a distal end of the engaging piece 132*b*.

In further exemplary embodiments, consequently, the connecting portion 132 suitably prevents the engaging piece 132*b* from being moved in a vertical direction in a state by closely overlapping the engaging piece 132*b* with the engaging surface 132*a*-1, and prevents the distal end of the engaging piece 132*b* from being disengaged in a rearward direction by supporting the locking surface 132*a*-2.

Preferably, the cut member 130 integrally connects the fixing member 110 and the barrel member 120 through the joint portion 131, and is broken by bending the cut member 130. In further preferred embodiments, the strength of the fixing member 110 and the barrel member 120 are suitably reinforced by the connecting portion 132 to maintain the appearance thereof.

The operation of the earth terminal 100 having the configuration described above according to certain exemplary embodiments of the present invention is described herein.

In a first exemplary embodiment, the earth wire (not shown) is suitably inserted in the wire barrel 121 formed on the barrel member 120, and then the wire barrel 121 is suitably pressed to fix the earth wire.

Preferably, after that, in order to fix the earth terminal 100, the bolt (not shown) is suitably fastened to the vehicle body through the fastening hole 111 of the fixing member 110 to suitably fix the fixing member 110 to the vehicle body.

Accordingly, the rotation preventive portion 112 formed on the fixing member 110 is suitably supported on the side of the vehicle body or is suitably inserted into a hole (not shown) formed on the vehicle body to prevent the fixing member 110 from rotate.

Preferably, the installing operation is completed by fixing a plurality of earth wires connected to a wire harness (not shown) to the vehicle body by using the earth terminal 100.

According to further exemplary embodiments of the present invention, after that, in a case in which the earth wire is suitably disengaged, the cut member 130 is bent or cut by pulling the earth wire in the upward direction or the bending the barrel member 120 in the upward direction.

Accordingly, if the cut member 130 is suitably bent, the engaging piece 132*b* of the engaging portion 132 is suitably rotated around the support piece 132*a* and is suitably released from the engaged state. Simultaneously, the bent portion of the weak portion 11*a* of the joint portion 131 is broken by the stress due to fatigue limit.

Accordingly, in further preferred embodiments, as a result, the cut member 130 is suitably bent and then broken, so that the fixing member 110 and the barrel member 120 are suitably separated to conveniently disengage the earth wire.

Although preferred embodiment of the present invention have been described for illustrative purposes herein, those skilled in the art will appreciate that various modifications, additions and substitutions are possible, without departing from the scope and spirit of the invention as disclosed in the accompanying claims.

What is claimed is:

1. An earth terminal comprising:

a fixing member fixed to a vehicle body by a bolt;

a barrel member to which an earth wire is inserted and fixed; and a cut member for connecting the fixing member and the barrel member, in which the cut member is broken or disengaged by bending, wherein the cut member comprises a joint portion formed at one portion of a surface corresponding to the fixing member and the barrel member, and a connecting portion formed at the other portion of the surface corresponding to the fixing member and the barrel member, and the joint portion is provided at its center portion thereof with a weak portion which is bent in a ∩-shaped cross-section.

2. The earth terminal of claim 1, wherein the connecting portion comprises a support piece formed on the fixing member in a cantilever form, and a connecting piece formed on the barrel member, wherein the commenting piece is formed in a hook shape to be connected to the support piece.

3. The earth terminal of claim 2, wherein the support piece comprises an engaging surface engaged to the engaging piece in an overlapped manner, and a locking surface supported by a distal end of the engaging piece.

4. The earth terminal of claim 1, wherein the fixing member further comprises a rotation preventive portion formed on one side of the fixing member and bent in a direction perpendicular to the fixing member.

5. An earth terminal comprising:

a fixing member fixed to a vehicle body by a bolt;

a barrel member to which an earth wire is inserted and fixed; and a cut member for connecting the fixing member and the barrel member, in which the cut member is broken or disengaged by bending, wherein the cut member comprises a joint portion formed at one portion of a surface corresponding to the fixing member and the barrel member, and a connecting portion formed at the other portion of the surface corresponding to the fixing member and the barrel member, and the connecting portion comprises a support piece formed on the fixing member in a cantilever form, and a connecting piece formed on the barrel member, wherein the commenting piece is formed in a hook shape to be connected to the support piece.

6. The earth terminal of claim 5, wherein the support piece comprises an engaging surface engaged to the engaging piece in an overlapped manner, and a locking surface supported by a distal end of the engaging piece.

* * * * *